US007000338B2

(12) United States Patent
Savard

(10) Patent No.: US 7,000,338 B2
(45) Date of Patent: Feb. 21, 2006

(54) POSITIONING DEVICE FOR SIDE WING

(76) Inventor: Normand Savard, 1097 Normandie, Baie-Comeau, QBC (CA) G5C 3P9

( * ) Notice: Subject to any disclaimer, the term of this patent is extended or adjusted under 35 U.S.C. 154(b) by 0 days.

(21) Appl. No.: 10/837,676

(22) Filed: May 4, 2004

(65) Prior Publication Data

US 2005/0252045 A1 Nov. 17, 2005

(51) Int. Cl.
*E01H 5/06* (2006.01)

(52) U.S. Cl. ..... 37/274; 37/281

(58) Field of Classification Search ..... 37/281, 37/283, 274, 266

See application file for complete search history.

(56) References Cited

U.S. PATENT DOCUMENTS

| | | | | |
|---|---|---|---|---|
| 2,643,470 A | | 6/1953 | Kaeser | |
| 2,991,566 A | | 7/1961 | Sumner et al. | |
| 3,659,363 A | | 5/1972 | Snyder | |
| 4,045,892 A | | 9/1977 | Farrell | |
| 4,096,652 A | * | 6/1978 | Raines et al. | 37/231 |
| 4,357,766 A | | 11/1982 | Croteau et al. | |
| 4,596,081 A | | 6/1986 | DeBilly et al. | |
| 4,969,280 A | * | 11/1990 | Thorneloe | 37/281 |
| 5,031,343 A | | 7/1991 | Houle et al. | |
| 5,048,207 A | * | 9/1991 | Verseef | 37/281 |
| 5,177,887 A | * | 1/1993 | McGugan et al. | 37/236 |
| 6,249,992 B1 | * | 6/2001 | Irving et al. | 37/281 |
| 6,412,200 B1 | * | 7/2002 | Savard | 37/281 |
| 6,581,307 B1 | * | 6/2003 | Jones et al. | 37/281 |

* cited by examiner

*Primary Examiner*—Meredith C. Petravick
(74) *Attorney, Agent, or Firm*—Protections Equinox Int'l; Franz Bonsang

(57) ABSTRACT

A device for selectively positioning a side wing relative to the side of a motor vehicle it is mounted on and to the adjacent road surface is disclosed. The device includes first and second longitudinal end members pivotally connected to the vehicle side and to a rearward end of the side wing about vertical axes; the front end of the wing is usually connected adjacent the front end of the vehicle. First and second elongate rams that are angularly positioned relative to one another are connected to the first and second end members. The first and second rams operate in parallel relative to each other for selective operation of the side wing from a position adjacent the vehicle side and away from the ground surface to a position in operative engagement with the road surface at an adjustable angle relative to the vehicle side.

27 Claims, 5 Drawing Sheets

POSITIONING DEVICE FOR SIDE WING

FIELD OF THE INVENTION

The present invention relates to side wings used with motor vehicles and is more particularly concerned with a positioning device therefore.

BACKGROUND OF THE INVENTION

It is well known in the art to use side wings, side blades, snow wings or the like aside a motor vehicle such as a snowplow or the like to increase the effective width spanning of the vehicle when used to push snow or other material covering a road surface or the like on the side thereof. Side wings are usually retracted and raised alongside of the vehicle when not in use and positioned at a predetermined angle relative thereto, on the road surface, when in use. Depending on the specific needs, the predetermined angle could be chosen to have the side wing extending laterally from the vehicle over a distance that is usually close to encompass the adjacent lane.

Several side wing mounting systems exist, a few examples of which are as follows:

- U.S. Pat. No. 2,643,470, issued Jun. 30, 1953, to Kaeser for "Wing Plow Structure";
- U.S. Pat. No. 2,991,566, issued Jul. 11, 1961, to Sumner et al. for "Snow Plow Blade Mounting Structure";
- U.S. Pat. No. 3,659,363, issued May 2, 1972, to Snyder for "Adjustable Wing Plow with Means for Positively Maintain Adjustment";
- U.S. Pat. No. 4,045,892, issued Sep. 6, 1977, to Farrell for "Hydraulically Operated Front and Rear Wing Hangers for Snow Plows";
- U.S. Pat. No. 4,096,652, issued Jun. 27, 1978, to Raines et al. for "Retractable Snowplow Wing and Mounting therefor";
- U.S. Pat. No. 4,357,766, issued Nov. 9, 1982, to Croteau et al. for "Snow Plow Side Wing Assembly";
- U.S. Pat. No. 5,031,343, issued Jul. 16, 1991, to Houle et al. for "Mounting Bracket for Side Wing Plow";
- U.S. Pat. No. 5,177,887, issued Jan. 12, 1993, to McGugan et al. for "Snow Wing";
- U.S. Pat. No. 6,249,992, issued Jun. 26, 2001, to Irving et al. for "Retractable Snow Plow Wing Assembly"; and
- U.S. Pat. No. 6,412,200, issued Jul. 2, 2002, to Savard for "Retractable Side Wing Assembly".

The front mounting structure of the side wing conventionally allows the front end of the side wing to be raised and lowered and to pivot between the extended and retracted side wing positions. The rear mounting structure of the side wing typically includes a pair of parallel arms extending between the vehicle and the side wing. Both arms, having a predetermined length, have their proximal end pivotally connected to the vehicle and their distal end pivotally connected to the side wing. An actuator extends between the proximal and distal ends of the arms at an angle therewith. The actuator is used to raise the side wing into the retracted position and lower it into the extended position.

Other rear mounting structures have the distal ends of the two arms, not necessarily parallel to each other, connected to the side wing via a second actuator typically mounted within a telescopic arm to vary the length thereof and operatively independent from the first actuator. Accordingly, the operator can select the position of the side wing relative to the vehicle depending on the desired lateral spanning of the side wing in the extended position.

All these rear mounting structures require a large amount of parts with rigid arms and at least one actuator. When an adjustable positioning of the side wing is desired, a relatively complex telescopic arm combined with a second actuator that can undergo the stress loads are added thus rendering the structure even more complex and susceptible to damages and frequent repairs.

Accordingly, there is a need for an improved side wing adjustable mounting device with a simple configuration.

SUMMARY OF THE INVENTION

It is therefore a general object of the present invention to provide a device for selectively positioning a side wing mounted on a vehicle side relative thereto and to a ground surface.

An advantage of the present invention is that the side wing positioning device allows for easy adjustment of the position of the side wing relative to the motor vehicle into the operative configuration.

Another advantage of the present invention is that the side wing positioning device is relatively simple in configuration and does generally not require the use of any additional rigid support arms, other than the actuators.

A further advantage of the present invention is that the side wing positioning device is and easy and quick to operate.

Still another advantage of the present invention is that the side wing positioning device allows for a wide angular adjustment of the position thereof relative to the motor vehicle.

Another advantage of the present invention is that the side wing positioning device enables the side wing to be rapidly lifted up from its extended configuration.

Still a further advantage of the present invention is that the side wing positioning device allows for a relatively low retracted and stowed position of the side wing along the side of the vehicle to significantly reduce the visual obstruction the stowed side wing causes to the vehicle driver.

Yet another advantage of the present invention is that the side wing positioning device is connected to the vehicle via a simple hinge structure that uses a minimum quantity of parts that are furthermore less susceptible to wear and failure than existing joint systems.

A further advantage of the present invention is that the side wing positioning device uses two double-acting actuators angularly positioned relative to each other and operatively connected in parallel.

Yet another advantage of the present invention is that the side wing positioning device is connected to the vehicle via a simple hinge structure.

According to an aspect of the present invention, there is provided a device for positioning a side wing mounted on a vehicle side relative thereto and to a ground surface, said device comprises: first and second elongate rams being angularly positioned relative to one another and defining an actuator plane; first and second longitudinal end members being pivotally connectable to a respective one of the vehicle side and the side wing about axes substantially parallel to said actuator plane, each of said first and second rams connecting to said first and second end members; said first and second rams operating in parallel relative to each other for operation between first and second positions such that the side wing is adjacent the vehicle side and away from the ground surface when said first and second rams are in said first position, and the side wing is away from the vehicle side and operatively engages the ground surface when said first and second rams are in said second position.

In one embodiment, the first and second rams pivotally connect to said first and second end members about axes substantially transversal to said actuator plane, and the latter is substantially vertically oriented.

In one embodiment, the first and second rams are double-acting hydraulic rams.

Typically, the device further includes a hydraulic valve hydraulically connecting to said first and second rams, said hydraulic valve being connectable to a source of pressurized hydraulic fluid to simultaneously control actuation of said first and second rams.

In one embodiment, the first and second rams are spaced apart from one another by first and second distances adjacent said first and second end members, said first distance being larger than said second distance.

Conveniently, the second distance is substantially null so that said first and second rams and said first end member substantially form a triangle.

Typically, the first ram includes a longitudinal extension thereof extending toward said second end member.

Typically, the second ram pivotally connects to said longitudinal extension of first ram adjacent said second end member.

In one embodiment, the first and second rams are actuatable into a third position intermediate said first and second positions such that the side wing is adjacent the vehicle side and operatively engages the ground surface when said first and second rams are in said third position.

Typically, the first and second rams are actuatable between retracted and extended configurations, both said first and second rams being substantially in said retracted and extended configurations when in said first and second positions.

Typically, the first ram is substantially horizontally oriented at said second and third positions and therebetween.

Typically, the first and second rams are actuatable between retracted and extended configurations, said first ram being substantially in said retracted configuration when in said first and third positions and therebetween.

Conveniently, the first and second rams moves from said first position to said third position under the action of the gravity acting on the side wing.

In one embodiment, the first and second rams are actuatable into a fourth position beyond said second position such that the side wing is away from the vehicle side and the ground surface when said first and second rams are in said fourth position.

Typically, the first and second rams are actuatable between retracted and extended configurations, both said first and second rams being substantially in said retracted and extended configurations when in said first and fourth positions. Conveniently, the second ram is substantially in said extended configuration when in said second and fourth positions and therebetween.

Typically, the first and second rams moves from said fourth position to said second position under the action of the gravity acting on the side wing.

In one embodiment, the first end member is a hinge connector. Typically, the hinge connector includes first and second hinge parts pivotally connecting to each other, said first and second rams pivotally connecting to said first hinge part, said second hinge part being mountable on the vehicle side.

Preferably, the hinge connector has a substantially vertically oriented hinge axis.

In one embodiment, the second ram has a collar pivotally connectable to the side wing about a collar axis.

Typically, the collar is further slidably connectable to the side wing along said collar axis that is preferably substantially vertically oriented.

In another aspect of the present invention, there is provided a motor vehicle for plowing material located onto an adjacent ground surface away from a vehicle side thereof, said vehicle comprises: a side wing having generally opposed first and second wing longitudinal ends, said first wing end being movably connected to the vehicle adjacent a front end thereof; a device for selectively positioning the side wing relative to the vehicle side and the road surface, said device including: first and second elongate rams being angularly positioned relative to one another and defining an actuator plane; first and second longitudinal end members pivotally connecting to a respective one of the vehicle side away from the front end and the side wing adjacent the second wing end about axes substantially parallel to said actuator plane, each of said first and second rams connecting to said first and second end members; said first and second rams operating in parallel relative to each other for operation between first and second positions such that the side wing is adjacent the vehicle side and away from the ground surface when said first and second rams are in said first position, and the side wing is away from the vehicle side and operatively engages the ground surface when said first and second rams are in said second position.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, wherein.

Similar references used in different Figures denote similar components.

DETAILED DESCRIPTION OF THE PREFERRED EMBODIMENTS

With reference to the annexed drawings the preferred embodiments of the present invention will be herein described for indicative purpose and by no means as of limitation.

Figure 1:
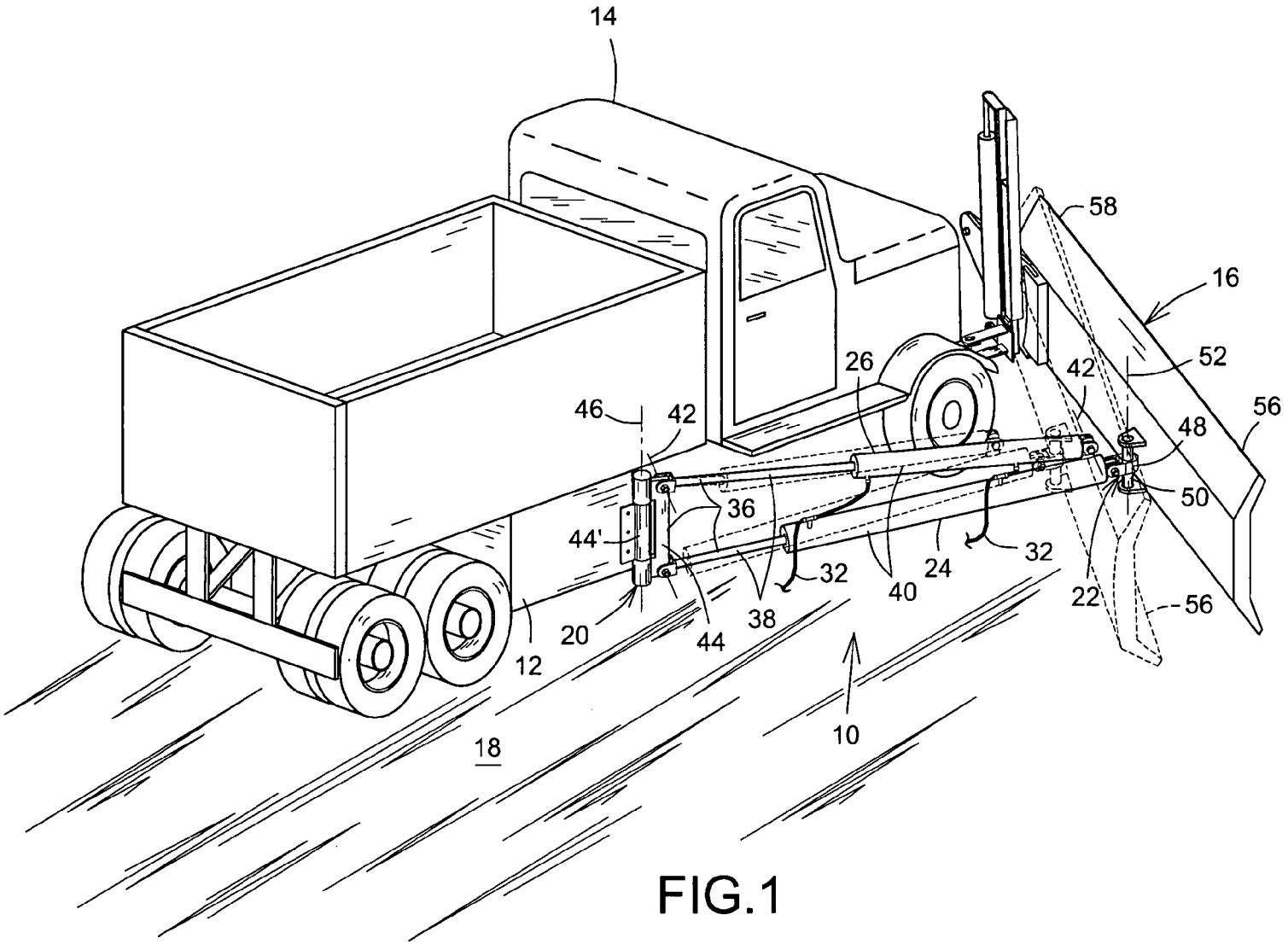
FIG. 1 is a schematic top perspective view of an embodiment of a side wing positioning device in accordance with the present invention connecting the rear end of the side wing to the side of a motor vehicle, showing the side wing in the operating extended and operating retracted positions in solid and dashed lines respectively.

Referring to FIG. 1, there is schematically shown an embodiment of a side wing positioning device 10 in accordance with the present invention mounted on a lateral side 12 of a motor vehicle 14, such as a plow truck or the like, to selectively position the side wing 16 relative thereto and relative to the adjacent ground or road surface 18.

The device 10 includes first 20 and second 22 longitudinal end members. Typically, the first end member 20 is pivotally connectable to the vehicle side 12 and the second end member 22 is pivotally connectable to the side wing 16.

The device 10 further includes first 24 and second 26 elongate rams that are angularly positioned relative to one another. Each ram 24, 26 is pivotally connected to the first and second end members 20, 22. The first and second rams 24, 26 are spaced apart from one another by first 28 and second 30 distances adjacent the first and second end members 20, 22. Typically, the first distance 28 is larger than the second distance 30 which is relatively substantially null or zero such that the first and second rams 24, 26 and the first end member 20 substantially form a triangle, as shown in FIGS. 1 and 2 through 5. One skilled in the art would readily understand that the second distance 30, although not physically zero in the embodiment 10 illustrated in the Figures, is assumed to be approximately zero notwithstanding the mechanical coupling constraints.

Figure 7:
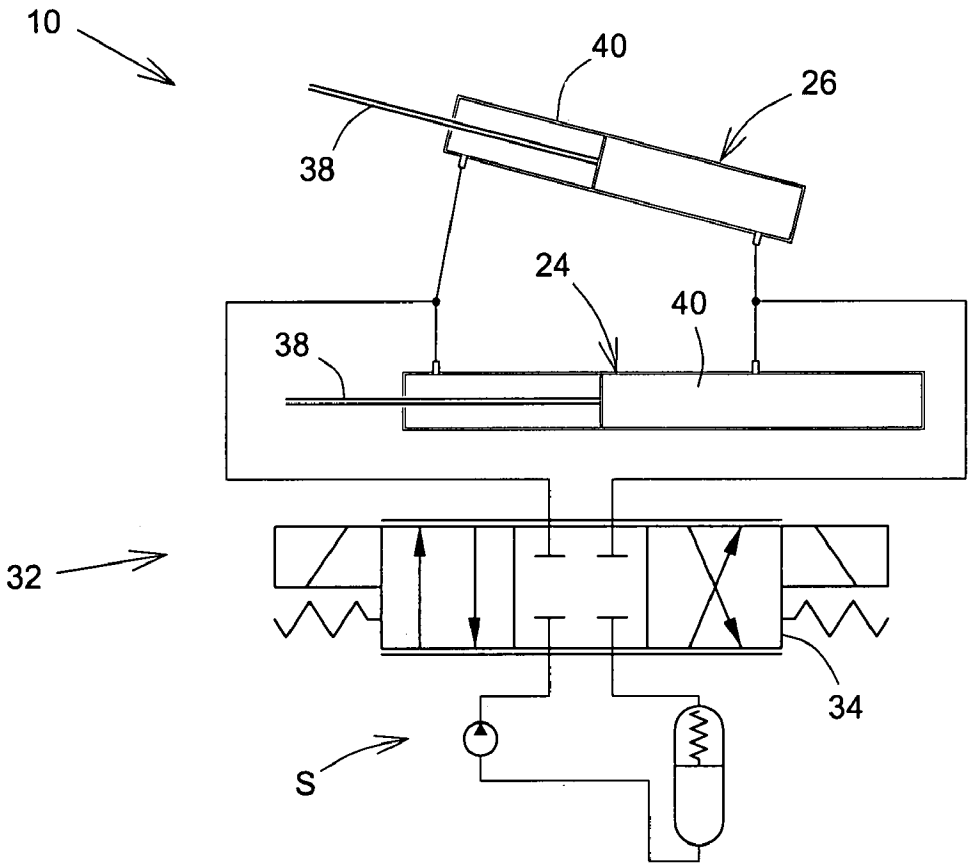
FIG. 7 is a schematic diagram of the hydraulic circuit of the embodiment of FIG. 1.

The first and second rams 24, 26, preferably double-acting hydraulic rams, are operatively connected in parallel relative to each other in the hydraulic circuit 32 such that only one operator controlled hydraulic valve 34 is required for the actuation of the two rams 24, 26, as shown in FIG. 7. The hydraulic circuit 32 is preferably connectable to an existing source of pressurized hydraulic fluid S available on the motor vehicle 14. Obviously, the hydraulic circuit 32 could be part of the device 10 that would preferably be connectable to the electric power circuit (not shown) of the vehicle 14 or the like. The valve 34, preferably a two-way valve with an intermediate closed position (or three-position valve), allows the operator to hydraulically actuate the two rams 24, 26 to control of the position of the side wing 16 relative to the vehicle side 12 and the adjacent road surface 18.

Typically, the first and second rams 24, 26 define an actuator plane 36 that is substantially vertically oriented. Each ram 24, 26 has a piston rod 38 slidably connecting to a cylinder housing 40. The piston rods 38 and the cylinder housings 40 are typically pivotally connected to the first and second end members 20, 22 respectively, about axes 42 substantially transversal to the actuator plane 36.

As shown more specifically in FIG. 1, the first end member 20 is typically a hinge type connector, also known as a strap hinge used on doors and the like, mounted on the vehicle side 12 typically away front a front end thereof in a rearward direction. The hinge 20 includes first and second hinge parts 44, 44' that are pivotally connected to each other via a substantially vertically oriented hinge axis 46. The axial length of the hinge 20 substantially defines the first distance 28. Preferably, both piston rods 38 are pivotally connected to first hinge part 44 in order to be jointly moveable about the hinge axis 46. The second hinge part 44' in generally mountable on the vehicle side 12.

The second end member 22 typically includes a collar 48 that pivotally connects to a mounting rod 50 of the side wing 16 about a collar axis 52 that is typically substantially vertically oriented. The mounting rod 50 is typically located adjacent a second longitudinal end or distal end 56 of the side wing 16, the first longitudinal end or proximal end 58 of the side wing 16 being generally pivotally connected to the vehicle 14 adjacent the front end thereof. Preferably, the collar 48 is slidably mounted on the mounting rod 50 along the collar axis 52 to allow for small vertical up and down displacements of the side wing 16 according to the leveling or local imperfections of the road surface 18.

As shown more specifically in FIGS. 2 through 5 in which the different views are taken at different angles since the device 10 is positioned at different angles relative to the vehicle side 12 about the hinge axis 46, the second ram 26 typically pivotally connects to the first ram 24 adjacent the second end member 22.

Typically, the cylinder housing 40 of the first ram 24 includes a longitudinal extension 60 thereof that pivotally connects to the collar 48. Similarly, the cylinder housing 40 of the second ram 26 includes a longitudinal extension 62 thereof that pivotally connects to the longitudinal extension 60 of the first ram 24, preferably at about half length of the longitudinal extension 60.

As seen throughout the Figures, the two rams 24, 26 are typically actuatable between retracted and extended configurations.

Figure 1A:
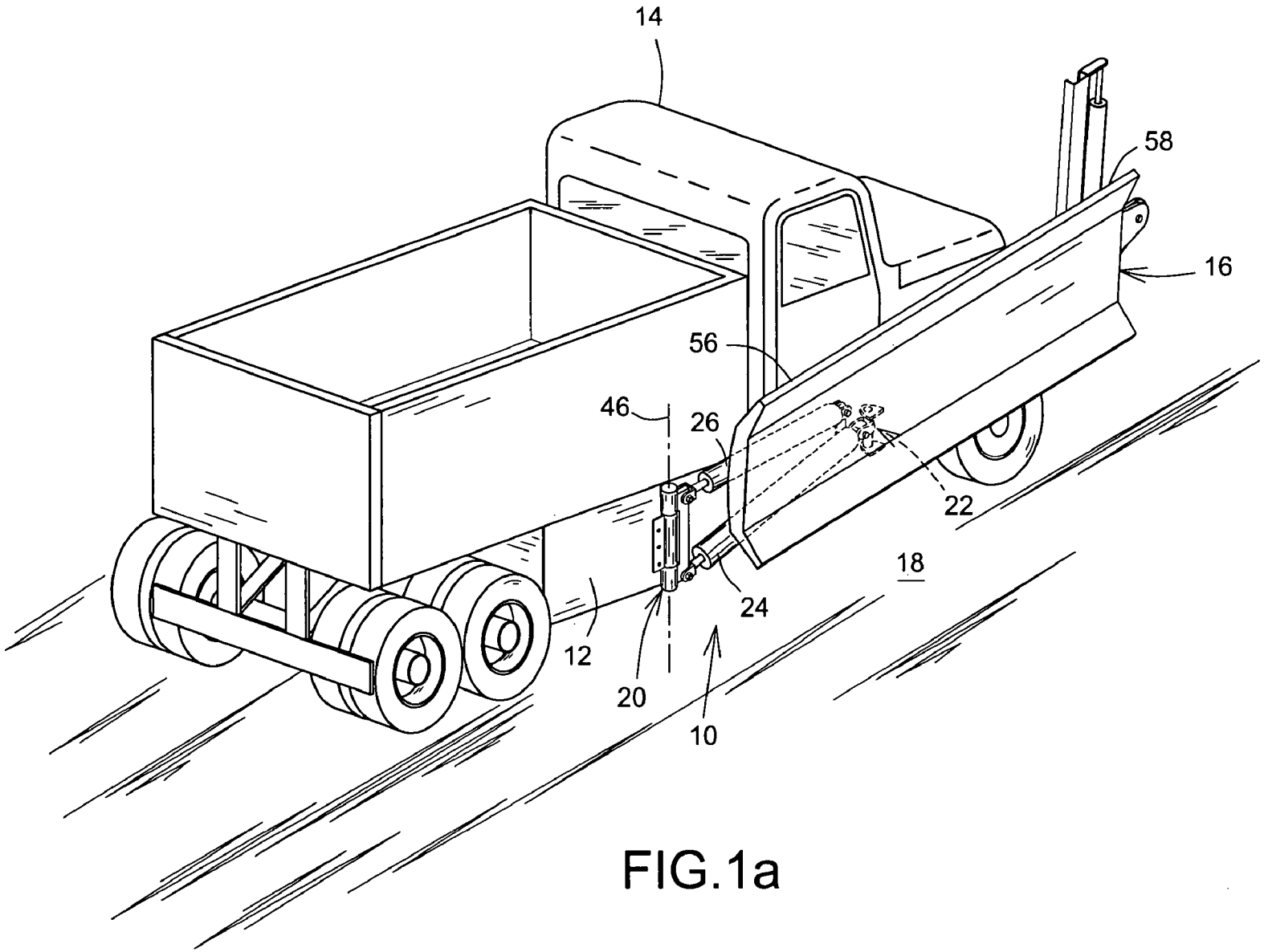
FIG. 1*a* is a view similar to FIG. 1, showing the side wing in its raised retracted position along the vehicle side.
Figure 2:
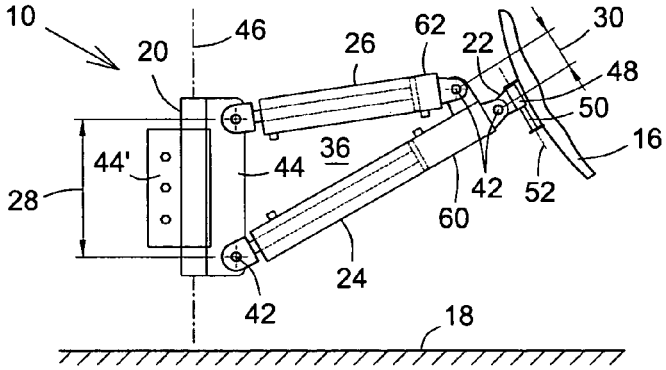
FIG. 2 is a schematic enlarged partial elevation view of the embodiment of FIG. 1 in the raised retracted position.
Figure 3:
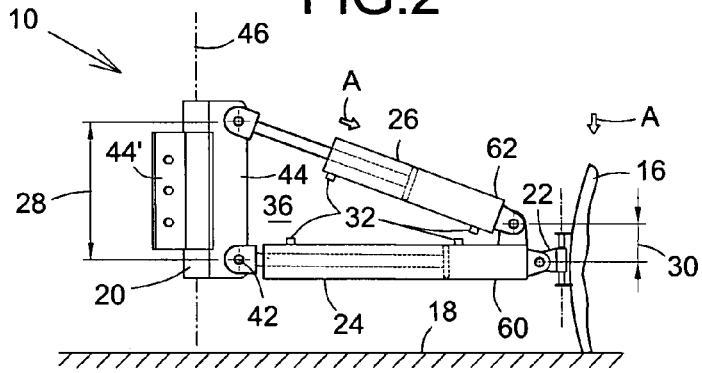
FIG. 3 is a schematic enlarged partial elevation view of the embodiment of FIG. 1 in the operating retracted position.
Figure 4:
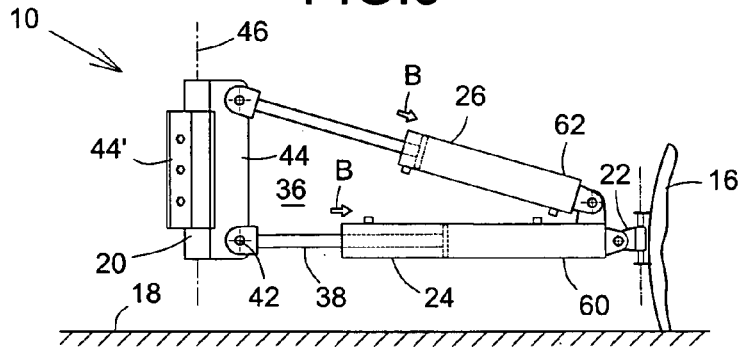
FIG. 4 is a schematic enlarged partial elevation view of the embodiment of FIG. 1 in the operating extended position.

Referring more specifically to FIGS. 1 to 5, the first and second rams 24, 26 operate between first and second positions of the side wing 16; the first position is the conventionally called stored, unused or raised retracted position and the second position is the conventionally called operating extended position. The side wing 16 is substantially adjacent the vehicle side 12 and away from the ground surface 18 when the first and second rams 24, 26 are in the first position as shown in FIGS. 1*a* and 2 and FIG. 6 in long dashed lines. The side wing 16 is substantially away from the vehicle side 12 and operatively engages the ground surface 18 when the first and second rams 24, 26 are in the second position as shown in FIG. 4 and FIGS. 1 and 6 in solid lines.

As shown in FIG. 3 and FIGS. 1 and 6 in short dashed lines, the first and second rams 24, 26 are typically actuatable into a third position of the side wing 16 intermediate the first and second positions. The side wing 16 is substantially adjacent the vehicle side 12 and operatively engages the ground surface 18 when the first and second rams 24, 26 are in the third position. As shown more specifically in FIG. 6 in short dashed lines, the third position, also conventionally called operating retracted position, is an operating position with a smaller lateral span than the usual operating extended position. That third position is very useful in multiple situations such as when protective ramps (not shown) are located on the side of the roads and when the motor vehicle 14 needs to make a relatively sharp turn at a road intersection or the like.

Figure 5:
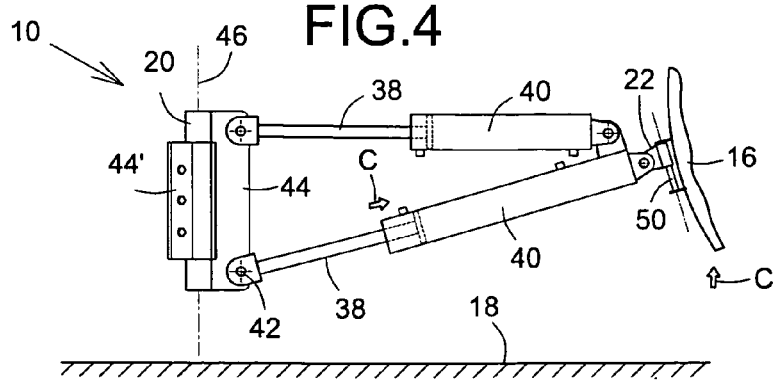
FIG. 5 is a schematic enlarged partial elevation view of the embodiment of FIG. 1 in the raised extended position.
Figure 6:
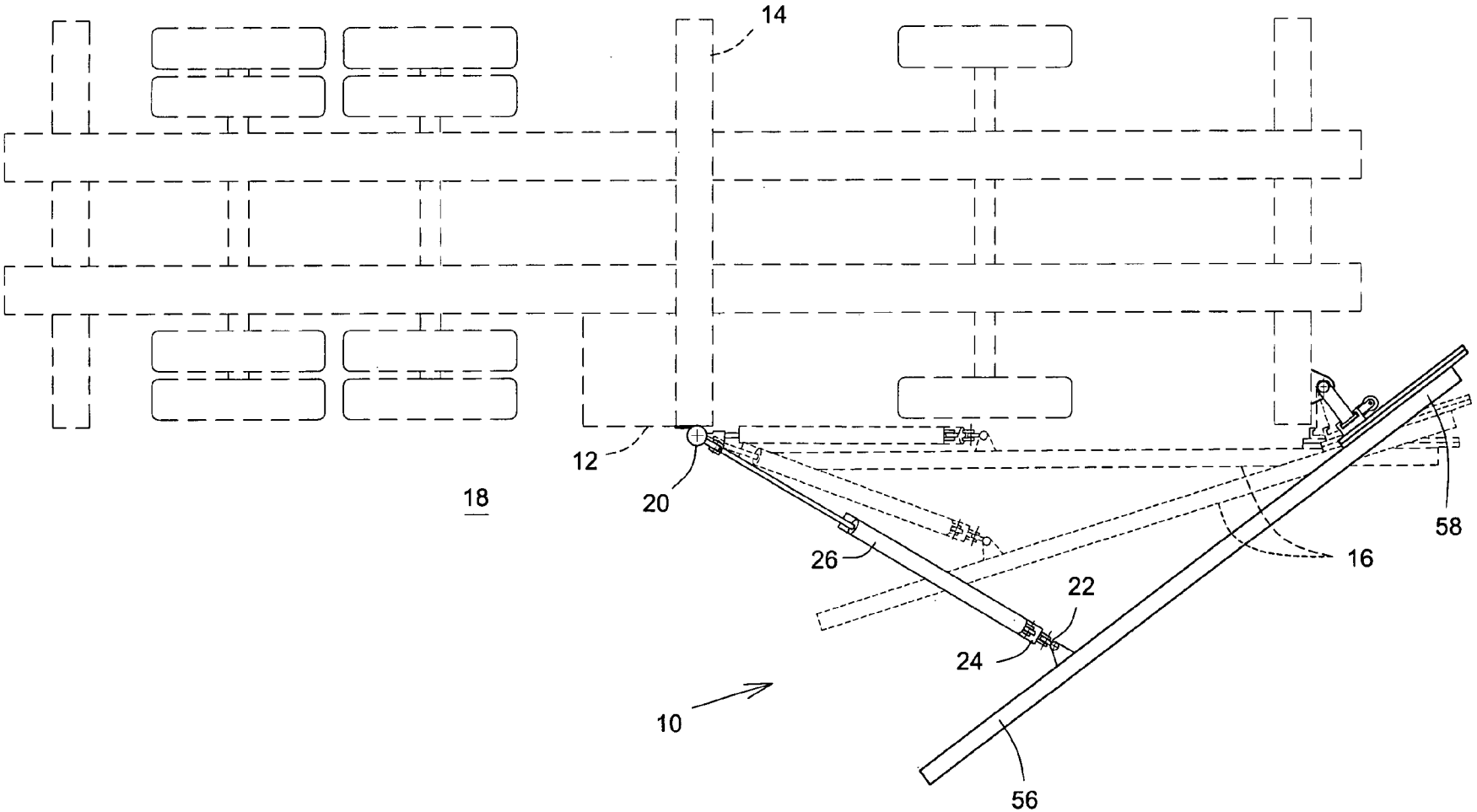
FIG. 6 is a schematic top plan view of the embodiment of FIG. 1, showing the side wing in the operating extended, operating retracted and raised retracted positions in solid, short and long dashed lines respectively.

As shown in FIG. 5, the first and second rams 24, 26 are typically actuatable into a fourth position beyond the second position. The side wing 16 is substantially away from the vehicle side 12 and the ground surface 18 when the first and second rams 24, 26 are in the fourth position, also conventionally called raised extended position. That fourth position is very useful in specific situations such as for a chopping of the upper portion of a snow or gravel pile along the edge of a road side or the like with the side wing 16 in order to provide room for further pushing of the snow thereon in a subsequent snow fall. One will understand that a too high of a snow pile could provide obstruction for an efficient operation of the side wing 16. Alternatively, the four position would allow for a rapid raising of the side wing 16 when the vehicle driver (and generally side wing operator, not shown) detects at the last minute a side wing obstruction (not shown) in front of the side wing 16 on the road surface 18.

Operation

When the side wing 16 is in the first raised retracted position along the vehicle side 12, the first ram 24 is in the retracted configuration and the second ram 26 is substantially in the retracted configuration, as shown in FIG. 2.

When the operator (not shown) needs to use the side wing 16, the hydraulic valve 34 is actuated in the extension position to start the extension of the side wing 16 away from the vehicle side 12. Under the gravitational weight of the side wing 16, the pressurized fluid will start flowing into the second ram 26 until the side wing 16 is substantially on the ground surface 18 in the third operating retracted position, as indicated by the arrows A in FIG. 3. Although not described herein, one skilled in the art would understand that prior to the actuation of the device 10, the proximal end 58 of the side wing 16 had been properly lowered adjacent the road surface 18, whenever required.

One skilled in the art would easily understand that the generally vertically oriented triangle formed by the device 10, the side wing 16 and the vehicle side 12 in the first position against the vehicle side 12 as seen in FIG. 1*a* remains substantially unchanged during the displacement of the side wing 16 into the third position in which the same triangle is generally horizontally oriented as seen in FIG. 6, since the first ram 24 remains in its retracted configuration.

After reaching the third position, if the operator maintains or re-activates the hydraulic valve 34 in the extension position, both first and second rams 24, 26 are simultaneously actuated toward their extended configuration until the second rams 26 reaches its extended configuration with the device 10 in the second operating extended position, as indicated by the arrows B in FIG. 4. As one skilled in the art would understand, the operator may decide to stop the rams' extension anywhere between the third and second positions of the device 10 to adjust the side wing 16 to the desired operating position. Although not required, the first ram 24 is preferably substantially horizontal at the second and third positions, and any position there between.

After reaching the second position, if the operator maintains or re-activates the hydraulic valve 34 in the extension position, the first ram 24 is further actuated toward its extended configuration while the second ram 26 remains in its extended configuration, until both rams 26 are in their extended configuration with the device 10 in the fourth raised extended position, as indicated by the arrows C in FIG. 5. The extension of the first ram 24 beyond the second position raises the side wing 16 away from the road surface 18 toward the vehicle side 12. One skilled in the art would easily understand that the generally horizontally oriented triangle formed by the device 10, the side wing 16 and the vehicle side 12 in the second position against the vehicle side 12 as seen in solid lines in FIGS. 1 and 6 remains substantially unchanged during the displacement of the side wing 16 toward the fourth position in which the same triangle is generally angularly oriented relative to the horizontal plane as illustrated in FIG. 5, since the second ram 26 remains in its extended configuration. As one skilled in the art would understand, the operator may decide to stop the first ram's extension anywhere between the second and fourth positions of the device 10 to adjust the height of the distal end 56 of the side wing 16 relative to the adjacent road surface 18.

For the reverse actuation of the first and second rams 24, 26, the operator actuates the hydraulic valve 34 in the retraction position to start the retraction of the side wing 16 toward the vehicle side 12. When the device 10 beyond the second position, in the fourth position or there between, the pressurized fluid will start flowing into the first ram 24 until the side wing 16 is substantially on the ground surface 18 in the second operating extended position under the gravitational weight of the side wing 16, as in an opposite direction of arrows C in FIG. 5.

After reaching the second position, if the operator maintains or re-activates the hydraulic valve 34 in the retraction position, both rams 24, 26 are simultaneously retracted toward their retracted configuration between the second and third positions, as in an opposite direction of arrows B in FIG. 4.

After reaching the third position, if the operator maintains or re-activates the hydraulic valve 34 in the retraction position, the second ram 26 is further actuated toward its retracted configuration while the first ram 24 remains in its retracted configuration, until the device 10 reaches the first raised retracted position, as in an opposite direction of arrows A in FIG. 3.

At any time, the operator may reverse the operation of the hydraulic valve 34 or stop the actuation of the two rams 24, 26 to maintain the side wing 16 in the selected position.

Alternatives

Although the embodiment 10 described hereinabove is shown With four positions, only the first and second positions could be considered depending on the proper configuration and sizes of the two rams 24, 26.

One skilled in the art would understand that other types of actuators, such as electric actuators with worm screws or the like (not shown) with corresponding switch controlled valves (not shown) and more complex control circuitry (not shown), could be used without departing from the scope of the present invention.

Although less practical and less effective, other orientations and/or connections of the first and second rams 24, 26 with the first and second end members 20, 22 could be considered without departing from the scope of the present invention; such as with, but not limited to, the shown device 10 turned up-side-down and flipped 180 degrees left-to-right (not shown); with the first and second end members 20, 22 connected to the side wing 16 and to the vehicle side 12 and with the first ram 24 located above the second ram 26 at an angle relative thereto.

While specific embodiments have been described, those skilled in the art will recognize many alterations that could be made within the spirit of the invention, which is defined solely according to the following claims.

I claim:

1. A device for positioning a side wing mounted on a vehicle side relative thereto and to a ground surface, said device comprising:

first and second elongate rams being angularly positioned relative to one another and defining an actuator plane;

first and second longitudinal end members being pivotally connectable to a respective one of the vehicle side and the side wing about axes substantially parallel to said actuator plane, each of said first and second rams connecting to said first and second end members;

said first and second rams operating in parallel relative to each other for operation between first and second positions such that the side wing is adjacent the vehicle side and away from the ground surface when said first and second rams are in said first position, and the side wing is away from the vehicle side and operatively engages the ground surface when said first and second rams are in said second position.

2. The device of claim 1, wherein said first and second rams pivotally connect to said first and second end members about axes substantially transversal to said actuator plane.

3. The device of claim 2, wherein said actuator plane is substantially vertically oriented.

4. The device of claim 1, wherein said first and second rams are double-acting rams.

5. The device of claim 4, wherein said first and second rams are hydraulic rams.

6. The device of claim 5, further including a hydraulic valve hydraulically connecting to said first and second rams, said hydraulic valve being connectable to a source of pressurized hydraulic fluid to simultaneously control actuation of said first and second rams.

7. The device of claim 1, wherein said first and second rams are spaced apart from one another by first and second distances adjacent said first and second end members, said first distance being larger than said second distance.

8. The device of claim 7, wherein said second distance is substantially null so that said first and second rams and said first end member substantially form a triangle.

9. The device of claim 8, wherein said first ram includes a longitudinal extension thereof extending toward said second end member.

10. The device of claim 9, wherein said second ram pivotally connects to said longitudinal extension of first ram adjacent said second end member.

11. The device of claim 1, wherein said first and second rams are actuatable into a third position intermediate said first and second positions such that the side wing is adjacent the vehicle side and operatively engages the ground surface when said first and second rams are in said third position.

12. The device of claim 11, wherein said first and second rams are actuatable between retracted and extended configurations, both said first and second rams being substantially in said retracted and extended configurations when in said first and second positions.

13. The device of claim 11, wherein said first ram is substantially horizontally oriented at said second and third positions and therebetween.

14. The device of claim 11, wherein said first and second rams are actuatable between retracted and extended configurations, said first ram being substantially in said retracted configuration when in said first and third positions and therebetween.

15. The device of claim 11, wherein said first and second rams moves from said first position to said third position under the action of the gravity acting on the side wing.

16. The device of claim 11, wherein said first and second rams are actuatable into a fourth position beyond said second position such that the side wing is away from the vehicle side and the ground surface when said first and second rams are in said fourth position.

17. The device of claim 16, wherein said first and second rams are actuatable between retracted and extended configurations, both said first and second rams being substantially in said retracted and extended configurations when in said first and fourth positions.

18. The device of claim 16, wherein said first and second rams are actuatable between retracted and extended configurations, said second ram being substantially in said extended configuration when in said second and fourth positions and therebetween.

19. The device of claim 16, wherein said first and second rams moves from said fourth position to said second position under the action of the gravity acting on the side wing.

20. The device of claim 7, wherein said first end member is a hinge connector.

21. The device of claim 20, wherein said hinge connector includes first and second hinge parts pivotally connecting to each other, said first and second rams pivotally connecting to said first hinge part, said second hinge part being mountable on the vehicle side.

22. The device of claim 21, wherein said hinge connector has a substantially vertically oriented hinge axis.

23. The device of claim 10, wherein said second ram has a collar pivotally connectable to the side wing about a collar axis.

24. The device of claim 23, wherein said collar is further slidably connectable to the side wing along said collar axis.

25. The device of claim 23, wherein said collar axis is substantially vertically oriented.

26. A motor vehicle for plowing material located onto an adjacent ground surface away from a vehicle side thereof, said vehicle comprising:

a side wing having generally opposed first and second wing longitudinal ends, said first wing end being movably connected to the vehicle adjacent a front end thereof;

a device for selectively positioning the side wing relative to the vehicle side and the road surface, said device including:

first and second elongate rams being angularly positioned relative to one another and defining an actuator plane;

first and second longitudinal end members pivotally connecting to a respective of the vehicle side away from the front end and the side wing adjacent the second wing end about axes substantially parallel to said actuator plane, each of said first and second rams connecting to said first and second end members;

said first and second rams operating in parallel relative to each other for operation between first and second positions such that the side wing is adjacent the vehicle side and away from the ground surface when said first and second rams are in said first position, and the side wing is away from the vehicle side and operatively engages the ground surface when said first and second rams are in said second position.

27. The vehicle of claim 26, wherein said first and second rams are hydraulic rams, said vehicle further including a hydraulic valve hydraulically connecting to said first and second rams, said hydraulic valve being connectable to a source of pressurized hydraulic fluid to simultaneously control actuation of said first and second rams.

* * * * *